US006041941A

United States Patent [19]

Newell et al.

[11] Patent Number: 6,041,941

[45] Date of Patent: Mar. 28, 2000

[54] REAGENT CONSUMPTION IN MINERAL SEPARATION CIRCUITS

[75] Inventors: Andrew Newell, Chatswood; Walter Hoecker, Rozelle, both of Australia

[73] Assignee: BOC Gases Australia Limited, New South Wales, Australia

[21] Appl. No.: 09/103,924

[22] Filed: Jun. 24, 1998

[51] Int. Cl.[7] ..... B03D 1/02; B03D 1/04; B03D 1/00

[52] U.S. Cl. ..... 209/164; 209/1; 209/166; 209/167; 241/24.13; 241/24.25

[58] Field of Search ..... 209/164, 166, 209/167, 1; 241/24.13, 24.25

[56] References Cited

U.S. PATENT DOCUMENTS

| | | |
|---|---|---|
| 1,505,323 | 8/1924 | Eberenz . |
| 2,048,370 | 7/1936 | Brinker . |
| 2,154,092 | 4/1939 | Hunt . |
| 3,893,915 | 7/1975 | Mercade . |
| 3,919,080 | 11/1975 | Sauter . |
| 4,270,926 | 6/1981 | Burk, Jr. et al. . |
| 4,735,783 | 4/1988 | Bulatovic . |
| 5,074,994 | 12/1991 | Ray et al. . |

FOREIGN PATENT DOCUMENTS

| | | |
|---|---|---|
| 499430 | 12/1976 | Australia . |
| B-41759/78 | 5/1979 | Australia . |
| B-50238/85 | 6/1986 | Australia . |
| 593065 | 2/1990 | Australia . |
| A-50588/93 | 5/1994 | Australia . |
| A-50633/93 | 6/1994 | Australia . |
| 1 106 529 | 8/1981 | Canada . |
| 2163688 | 5/1996 | Canada . |
| 37-15310 | 9/1962 | Japan . |
| 60-220155 | 10/1985 | Japan . |
| WO 89/00457 | 1/1989 | WIPO . |
| WO 89/10792 | 11/1989 | WIPO . |
| 96/01150 | 1/1996 | WIPO . |

OTHER PUBLICATIONS

Xu et al., "Sphalerite Reverse Floating Using Nitrogen," Proc. Electrochem Soc., vol. 92–17, Proc. Int. Symp. Electrochem. Miner. Met. Process. III, 3rd, pp. 170–190 (1992).

Kongolo et al., "Improving the efficiency of sulphidization of oxidized copper ores by column and inert gas flotation," Proceedings of COPPER 95–COBRE 95 International Conference, vol. II, The Metallurgical Society of CIM, pp. 183–196, 1995.

*Primary Examiner*—Thomas M. Lithgow

[57] ABSTRACT

A method for reducing both reagent consumption and scale formation in a mineral separation circuit employing sulfoxy compounds as reagents. The method involves introducing into the mineral separation circuit a non-oxidizing gas in a quantity sufficient to reduce the degree of oxidation of the sulfoxy radical. Preferably the gas is introduced during the reagent conditioning and flotation stages, the stages where the presence of dissolved oxygen in a slurry is most likely to create the conditions conducive to oxidation of the sulfoxy radicals which result in reagent consumption and scale formation problems. The process is suitable for a wide range of mineral separation circuits which use sulfoxy reagents for the separation of sulfidic minerals including chalcopyrite, pentlandite, pyrite, sphalerite, pyrrhotite or galena.

9 Claims, 2 Drawing Sheets

REAGENT CONSUMPTION IN MINERAL SEPARATION CIRCUITS

TECHNICAL FIELD

This invention relates to a method of reducing both reagent consumption and scale formation in a mineral separation circuit employing sulfoxy compounds as reagents.

BACKGROUND OF THE INVENTION

In the flotation separation of minerals, reagents containing a sulfoxy radical, such as sodium sulfite, sodium bisulfite and sodium metabisulfite (or alkali metal or alkaline earth metal equivalents), sulfur dioxide or other thionates are used to improve the quality of the separation, particularly where sulfidic minerals such as chalcopyrite, pentlandite, pyrite, sphalerite, pyrrhotite or galena are present.

While such reagents are effective per se, unfortunately, the sulfoxy groups are susceptible to oxidation and, therefore, need to be continuously replenished during the mineral separation process to maintain their efficiency and thus the quality of the separation.

Oxidation may be caused by the presence of dissolved oxygen in water used within the mineral separation circuit which reacts with the sulfoxy compound to ultimately produce sulfate anions. Because such side reactions of dissolved oxygen and sulfoxy compounds result in consumption of sulfoxy compounds, increased dosage levels of sulfoxy compounds are required. Loss of sulfoxy reagents in this manner is endured by many flotation operations and may be a major cost, in some cases exceeding 25% of the milling costs.

Further, water present within the mineral separation circuit usually contains high levels of cations such as calcium and magnesium which can react with the sulfate anions. The result is a degree of side-reaction which creates significant quantities of precipitate or scale, typically gypsum, i.e. calcium sulfate. This scale builds up on the internal surfaces of processing equipment, notably pH control and level control probes and discharge sections. It goes without saying that such problems interfere with the effective control of the mineral separation process and extended maintenance periods are required for scale removal. Needless to say, both the loss of process control and excessive maintenance can have detrimental economic consequences.

Additionally, the supply of such sulfoxy compounds, generally as solids, to remotely located flotation plant sites, as well as storage and preparation for use result in costs which have significant effects on the economics and productivity of such sites. Hence, it will be appreciated that these costs can be minimized by the more efficient use of sulfoxy radical-containing reagents in the process. In this manner, the present invention seeks to overcome at least some of the problems of the prior art or at least provide a commercial alternative to prior art techniques.

SUMMARY OF THE INVENTION

The present invention provides a method of reducing both the consumption of sulfoxy radical-containing reagents and scale formation in a mineral separation circuit employing a sulfoxy radical-containing reagent wherein the sulfoxy radical-containing reagent is introduced to the mineral separation circuit in combination with the introduction of a non-oxidizing gas to reduce oxidation of the sulfoxy radical.

DETAILED DESCRIPTION OF THE PREFERRED EMBODIMENTS

Figure 1:
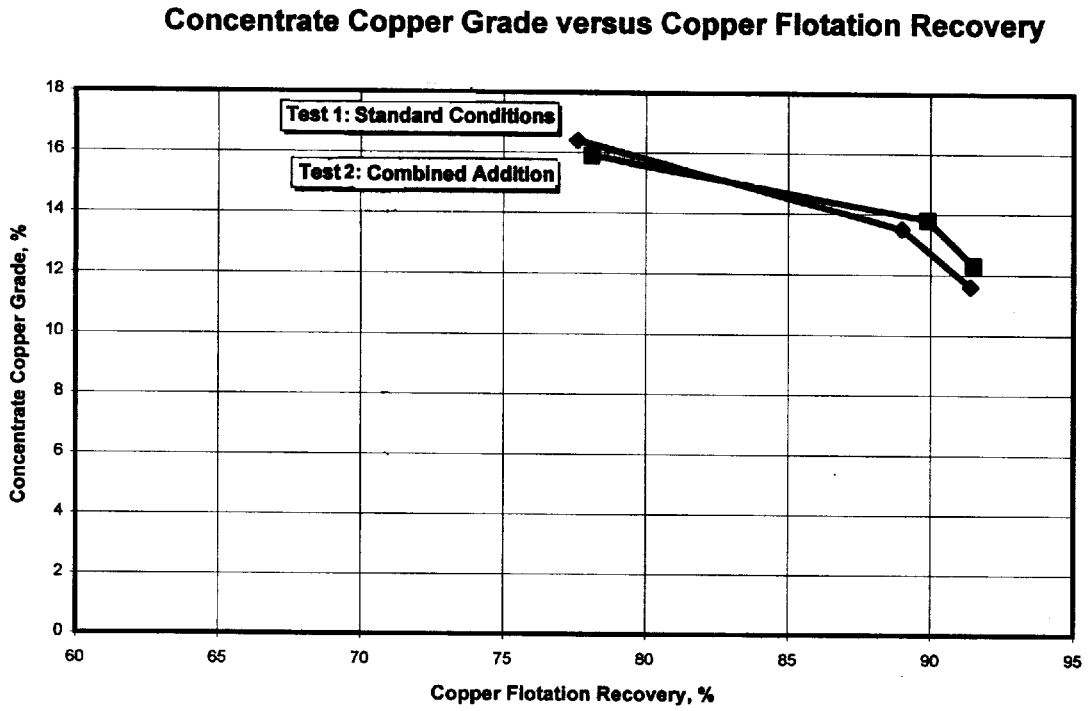
FIG. 1 is a graph showing the copper concentrate grade versus copper flotation recovery, for tests 1 and 2.

In accordance with the present invention, a non-oxidizing gas is introduced into a conventional mineral separation circuit which utilizes sulfoxy radical-containing reagents, typically as depressants, to significantly reduce the oxidation thereof. Suitable sulfoxy radical-containing compounds utilized for this purpose include bisulfite and sulfite compounds, alkali metal, ammonium or alkaline earth metal salts thereof, for example, alkali metal salts containing sulfoxy radicals.

The non-oxidizing gas is conveniently to be selected from the group consisting of inert gases, carbon dioxide and sulfur dioxide, the latter possessing an additional advantage in that it may itself be utilized as a sulfoxy radical-containing reagent. Of the inert gases, nitrogen is most preferred for cost reasons, but other art-recognized inert gases such as argon may be used as well.

The non-oxidizing gas is introduced at one or more stages of the mineral separation circuit where the presence of dissolved oxygen in a slurry passing through is most likely to create the conditions conducive to oxidation of sulfoxy radicals with the resultant problems of reagent consumption and scale formation. The non-oxidizing gas is preferably added during any or all of the reagent conditioning and flotation stages, but may also be introduced during the milling stages with beneficial results.

The rate of addition of the non-oxidizing gas should be at a rate that reduces oxygen levels below those likely to result in sulfation, that is oxidation of the sulfoxy radicals introduced by usage of sulfoxy radical-containing reagents in the mineral separation circuit. The addition rate of the non-oxidizing gas may consequently be controlled by determining the level of dissolved oxygen level or the electrochemical potential in slurries within the milling, conditioning or flotation stages of a mineral separation plant and adjusting the rate of non-oxidizing gas in accordance therewith. In this way, feedback control over the rate of addition of the non-oxidizing gas may be achieved. Suitable dissolved oxygen and electrochemical potential sensors are known from use in chemical processes and thus further description is not provided herein.

Although the above description implies the use of a single non-oxidizing gas, this is not mandated by the present invention and mixtures of non-oxidizing gases such as those described above may be used as desired. The non-oxidizing gas as mentioned hereinabove may be used to replace a portion of the air in, for example, flotation cells or columns in a mineral separation circuit. Therefore, conventional equipment in use for gas/liquid contact in the mineral separation circuit will be equally applicable in a circuit using the method of the invention.

Alternatively, the non-oxidizing gas may be sparged into a slurry prior to flotation in, for example, conditioning or other tanks or even the pipelines used to convey mineral separation circuit slurries from one stage of the process to another.

As the method of the invention is applicable to any mineral separation circuit utilizing sulfoxy radical-containing reagents, usually as depressants, a detailed description of the arrangement and operation of such mineral separation circuits is readily accessible and apparent to those skilled in the art and is therefore not necessary and not provided herein.

In order that the nature of the present invention may be more clearly understood, the following examples are provided. Flotation tests were conducted on two samples of reagentized flotation slurry from a complex massive sulphide copper/lead/zinc ore to establish the reduction in sulfoxy compound consumption possible by addition with nitrogen. The valuable minerals present included chalcopyrite (Copper), galena (Lead), and sphalerite (Zinc). The major non-valuable sulphide mineral was pyrite. In the examples that follow, the intended role of the sulfoxy compound was to improve the flotation selectivity of the copper minerals from the lead and zinc minerals.

SAMPLE 1

Two tests were conducted on a fresh sample of reagentized flotation plant feed slurry assaying 1.1% Copper, 2.7% Lead, and 8.3% Zinc.

TEST 1

Standard Conditions

The slurry was fed to a 2.5 liter laboratory flotation cell and floated according to the following operations and reagent additions:

| Operation | Time Minutes | SMBS Addition, gpt | Collector Addition gpt |
|---|---|---|---|
| Conditioning | 1 | 1350 | — |
| Reagent addition | — | — | 22 |
| Conditioning with air | 1 | — | — |
| Reagent addition | — | 900 | — |
| Flotation - Concentrate 1 | 1 | — | — |
| Reagent addition | — | 450 | — |
| Flotation - Concentrate 2 | 2 | — | — |
| Flotation - Concentrate 3 | 2 | — | — |

Sodium meta bisulfite (SMBS) was the sulfoxy type compound. The collector was approximately 60 percent Isopropyl ethyl thiocarbamate and 40 percent sodium di-isobutyl di-thio phosphate. The frother, which was already present, was methyl isobutyl carbinol.

The three concentrates and flotation tailings were filtered, dried, weighed, and the copper, lead, and zinc contents determined by assay.

TEST 2

Combined Addition of Sulfoxy Compound with Inert Gas

A test was conducted in a similar manner described for Test 1 with the following exceptions:

1. The slurry was conditioned with a nitrogen gas purge of sufficient flow immediately prior to SMBS additions until the dissolved oxygen content of the slurry as measured with an appropriate sensor indicated essentially no dissolved oxygen present and during SMBS additions to maintain essentially no dissolved oxygen present.
2. Each of the SMBS addition rates were reduced to 67 percent of the standard addition rates.

The total addition rate of SMBS was 1810 gpt versus the standard requirement of 2700 gpt.

SAMPLE 2

Two tests were conducted on a second sample of reagentized flotation plant feed slurry assaying 1.1% Copper, 2.7% Lead, and 7.8% Zinc.

TEST 3

Standard Conditions

A test was conducted in a similar manner described for Test 1.

TEST 4

Combined Addition of Sulfoxy Compound with Inert Gas

A test was conducted in a similar manner described for Test 1 with the following exceptions:

1. The slurry was conditioned with a nitrogen gas purge of sufficient flow immediately prior to SMBS additions until the dissolved oxygen content of the slurry as measured with an appropriate sensor indicated essentially no dissolved oxygen present and during SMBS additions to maintain essentially no dissolved oxygen present.
2. Each of the SMBS addition rates were reduced to 50 percent of the standard addition rates.

The total addition rate of SMBS was 1350 gpt versus the standard requirement of 2700 gpt.

RESULTS

The results of the evaluation are summarized as follows:

| Test 1: Standard Conditions | | | | | | |
|---|---|---|---|---|---|---|
| | Concentrate Copper Grade, % | | | Flotation Recovery, % | | |
| Product | Cu | Pb | Zn | Cu | Pb | Zn |
| Concentrate 1 | 16.4 | 4.7 | 5.3 | 77.6 | 8.4 | 3.1 |
| Concentrates 1 + 2 | 13.5 | 5.8 | 6.2 | 89.0 | 14.4 | 5.0 |
| Concentrates 1 + 2 + 3 | 11.6 | 6.6 | 7.1 | 91.4 | 19.6 | 6.9 |

| Test 2: Combined Addition | | | | | | |
|---|---|---|---|---|---|---|
| | Concentrate Copper Grade, % | | | Flotation Recovery, % | | |
| Product | Cu | Pb | Zn | Cu | Pb | Zn |
| Concentrate 1 | 15.9 | 3.6 | 4.4 | 78.1 | 7.1 | 2.9 |
| Concentrates 1 + 2 | 13.8 | 4.6 | 5.6 | 89.8 | 12.2 | 4.8 |
| Concentrates 1 + 2 + 3 | 12.3 | 5.3 | 6.5 | 91.5 | 15.9 | 6.3 |

| Test 3: Standard Conditions | | | | | | |
|---|---|---|---|---|---|---|
| | Concentrate Copper Grade, % | | | Flotation Recovery, % | | |
| Product | Cu | Pb | Zn | Cu | Pb | Zn |
| Concentrate 1 | 15.1 | 4.9 | 5.7 | 81.3 | 10.3 | 4.1 |
| Concentrates 1 + 2 | 12.6 | 6.2 | 6.5 | 90.4 | 17.3 | 6.3 |

-continued

| Test 1: Standard Conditions | | | | | | |
|---|---|---|---|---|---|---|
| | Concentrate Copper Grade, % | | | Flotation Recovery, % | | |
| Product | Cu | Pb | Zn | Cu | Pb | Zn |
| Concentrates 1 + 2 + 3 | 11.2 | 7.1 | 7.1 | 92.2 | 22.5 | 7.8 |
| **Test 4: Combined Addition** | | | | | | |
| | Concentrate Copper Grade, % | | | Flotation Recovery, % | | |
| Product | Cu | Pb | Zn | Cu | Pb | Zn |
| Concentrate 1 | 13.7 | 4.5 | 5.8 | 86.1 | 11.8 | 5.3 |
| Concentrates 1 + 2 | 12.0 | 5.5 | 6.6 | 91.8 | 17.7 | 7.3 |
| Concentrates 1 + 2 + 3 | 11.1 | 6.0 | 7.1 | 92.8 | 20.9 | 8.6 |

Comparing the results of Test 1 with Test 2 and Test 3 with Test 4 it will be readily apparent that the addition of nitrogen permitted essentially identical metallurgical performance at significantly lower SMBS additions as measured by concentrate copper grade, copper flotation recovery, and flotation selectivity of copper against lead and zinc.

Figure 2:
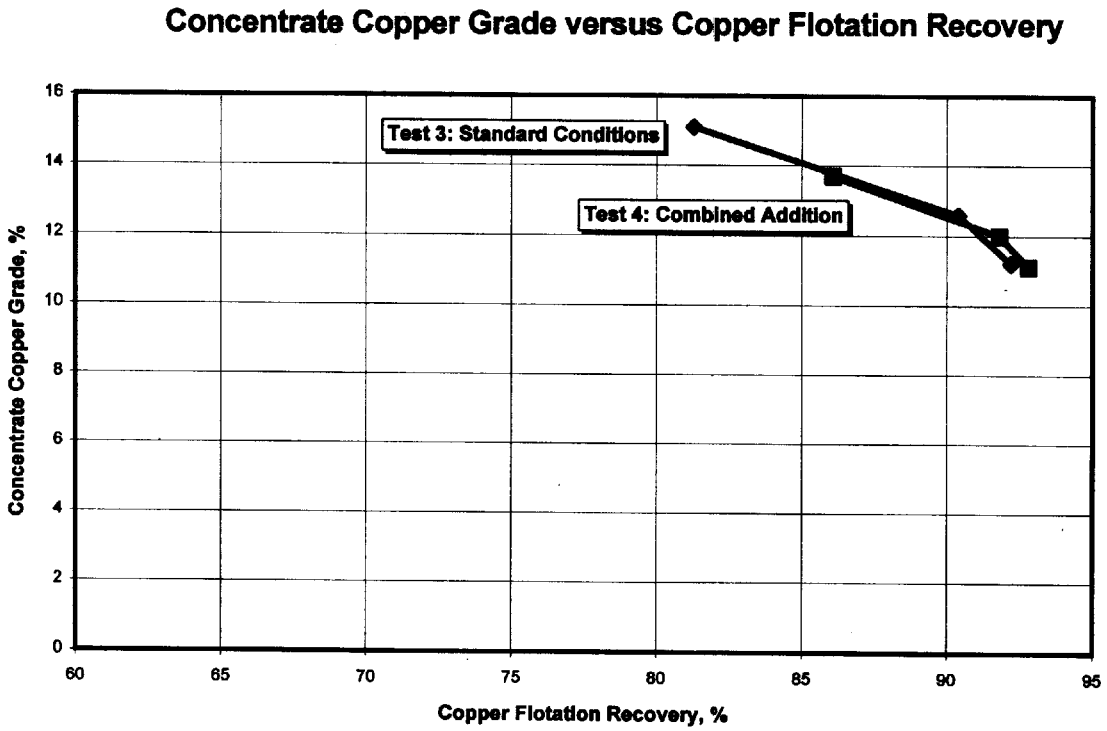
FIG. 2 is a graph of copper concentrate grade versus copper flotation recovery for tests 3 and 4.

Turning to the drawings, in the data shown in FIG. 1 and FIG. 2, it can be seen that the addition of the inert gas, in this case nitrogen, in combination with the sulfoxy compound allowed similar concentrate copper grade and copper flotation recovery to be achieved at significantly lower rates of sulfoxy compound. For this ore it is desirable to produce a copper concentrate of high copper grade.

Figure 3:
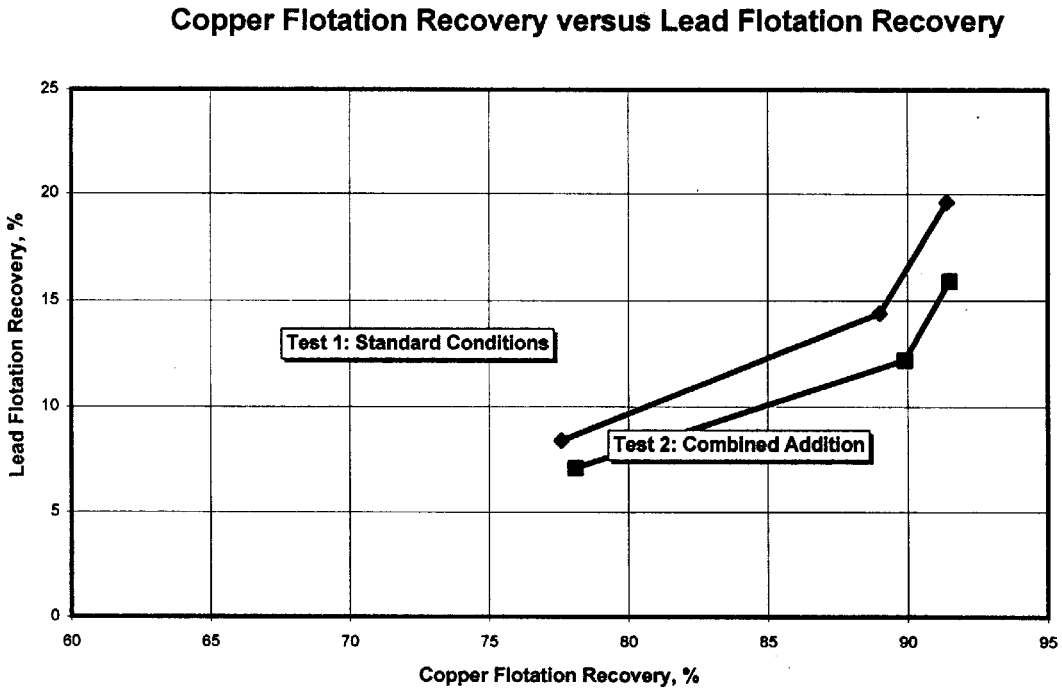
FIG. 3 is a graph of lead flotation recovery versus copper flotation recovery for tests 1 and 2.
Figure 4:
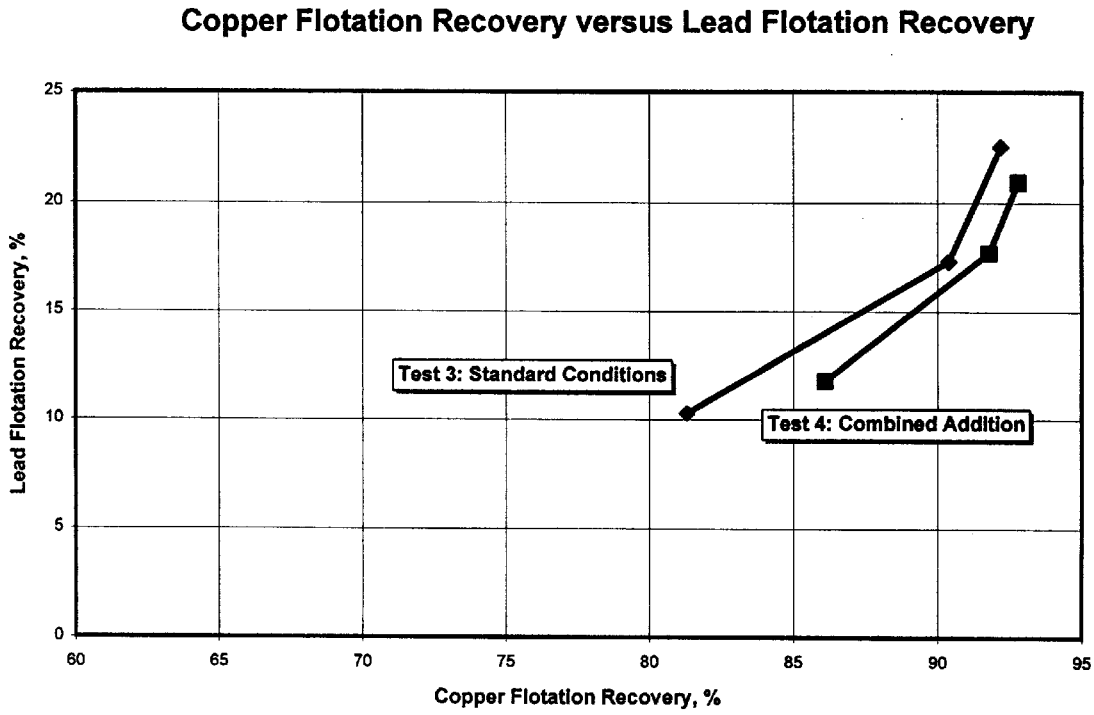
FIG. 4 is a graph of lead flotation recovery versus copper flotation recovery for tests 3 and 4.

It is also desirable to separate copper from lead, therefore giving the highest copper flotation recovery while maintaining the lowest lead flotation recovery. FIG. 3 and FIG. 4 once again show that the combined addition of the inert gas with the sulfoxy radical containing reagent has given the required flotation selectivity of copper against lead but at significantly lower addition rates of sulfoxy compound.

The use of inert gases, such as nitrogen, to significantly lower the addition rates (consumptions) of sulfoxy compounds may allow the application of the process of the present invention to a wider range of ores and mineral separations than previously thought possible. The reduction in sulfoxy compounds addition plus the exclusion of oxygen resulting from the addition of the non-oxidizing gas work to reduce scale formation. A further factor in scale reduction is that, when the non-oxidizing gas is an inert gas, it may be removing dissolved carbon dioxide that would otherwise form calcium carbonate scale. Scale formation is undesirable from two points of view, build up on the processing equipment and also deposition on valuable mineral surfaces thereby reducing their floatability.

The present invention is suitable for a wide range of ores including but not limited to ores with valuable sulfidic copper minerals, sulfidic and non-sulfidic copper minerals, non-valuable sulfidic iron minerals and non-sulfidic gangue materials. It is also suitable for use with sedimentary copper deposits, copper skarns, porphyry copper/molybdenum/gold deposits or super gene enrichments.

While the examples show reductions in the consumption of sulfoxy reagents in the order of several kilograms per ton of ore treated, the present inventive process is also suitable in instances where reduction in the consumption of the sulfoxy reagent may only be a few hundred grams per ton.

It will be appreciated that the method described may be embodied in other forms without departing from the spirit or scope of the invention as defined by the attached claims.

We claim:

1. A method of reducing the consumption rate of sulfoxy radical-containing reagents selected from the group consisting of sulfur dioxide, compounds containing bisulfite and sulfite radicals, and alkali metal, alkaline earth metal and ammonium salts of such compounds in a mineral circuit wherein such reagents are present in a slurry formed in the mineral separation circuit comprising providing a non-oxidizing gas comprising one or more inert gases in the slurry thereby reducing the degree of oxidation of the sulfoxy radical.

2. A method in accordance with claim 1, wherein the non-oxidizing gas is sparged into the slurry prior to flotation in the conditioning tank of the mineral separation circuit, or in the pipelines used to convey the slurry from one stage of the mineral separation circuit to another.

3. A method in accordance with claim 1, wherein a sulfoxy radical-containing reagent is selected from the group consisting of sodium sulfite, sodium metabisulfite, sodium bisulfite and mixtures thereof.

4. A method in accordance with claim 1, wherein the mineral separation circuit comprises a flotation cell stage employing a flotation gas and at least a portion of the flotation gas used in the flotation cell stage of the mineral spearation circuit comprises one or more of the non-oxidizing gases.

5. A method in accordance with claim 1, wherein the inert gas is nitrogen.

6. A method in accordance with claim 1, wherein the non-oxidizing gas is introduced into the slurry during at least one of the reagent conditioning and flotation stages of the mineral separation circuit.

7. A method in accordance with claim 1, wherein the non-oxidizing gas is introduced into the slurry immediately before introduction of the sulfoxy radical-containing reagent.

8. A method in accordance with claim 1, wherein the non-oxidizing gas is introduced during the milling stage of the mineral separation circuit.

9. A method in accordance with claim 1, wherein the rate of addition of the non-oxidizing gas is controlled by reference to determined values of dissolved oxygen levels or electrochemical potential in slurries within the milling, conditioning or flotation stages of the mineral separation circuit.

* * * * *